US006694950B2

(12) United States Patent
Djordjevic

(10) Patent No.: US 6,694,950 B2
(45) Date of Patent: Feb. 24, 2004

(54) HYBRID CONTROL METHOD FOR FUEL PUMP USING INTERMITTENT RECIRCULATION AT LOW AND HIGH ENGINE SPEEDS

(75) Inventor: Ilija Djordjevic, East Granby, CT (US)

(73) Assignee: Stanadyne Corporation, Windsor, CT (US)

( * ) Notice: Subject to any disclaimer, the term of this patent is extended or adjusted under 35 U.S.C. 154(b) by 0 days.

(21) Appl. No.: 10/187,823

(22) Filed: Jul. 2, 2002

(65) Prior Publication Data

US 2002/0174855 A1 Nov. 28, 2002

Related U.S. Application Data

(63) Continuation-in-part of application No. 09/913,661, filed as application No. PCT/US00/04096 on Feb. 17, 2000, now Pat. No. 6,422,203.

(60) Provisional application No. 60/318,375, filed on Sep. 10, 2001, and provisional application No. 60/120,546, filed on Feb. 17, 1999.

(51) Int. Cl.[7] ..... F02M 37/04

(52) U.S. Cl. ..... 123/446; 123/456

(58) Field of Search ..... 123/446, 456, 123/514, 506, 458, 357, 179.17

(56) References Cited

U.S. PATENT DOCUMENTS 4,884,545 A * 12/1989 Mathis ..... 123/447
5,884,606 A * 3/1999 Kellner et al. ..... 123/446
5,941,214 A * 8/1999 Hoffmann et al. ..... 123/456
6,058,912 A 5/2000 Rembold et al. ..... 123/179.17
6,113,361 A * 9/2000 Djordjevic ..... 417/383
6,135,090 A 10/2000 Kawachi et al. ..... 123/446
6,142,120 A * 11/2000 Biester et al. ..... 123/456
6,234,148 B1 * 5/2001 Hartke et al. ..... 123/447
6,237,573 B1 5/2001 Onishi et al. ..... 123/506
6,293,253 B1 * 9/2001 Arnold et al. ..... 123/458
6,345,609 B1 * 2/2002 Djordjevic ..... 123/509

FOREIGN PATENT DOCUMENTS

EP 1 072 781 A2 11/2002

* cited by examiner

*Primary Examiner*—Carl S. Miller
(74) *Attorney, Agent, or Firm*—Alix, Yale & Ristas, LLP

(57) ABSTRACT

In a fuel supply system for an internal combustion engine, a method for controlling fuel quantity delivery from a high pressure, reciprocating piston, engine-driven fuel pump to a high-pressure common rail having a plurality of fuel injection nozzles for injecting fuel into the cylinders of the engine. At least two control regimes are established corresponding to a respective low engine speed pump operation and high engine speed pump operation. During low speed operation, unregulated low pressure fuel is fed to the pumping pistons and at a location between the pistons and the common rail, excess fuel discharged from the pistons is diverted to a location of relatively low pressure in the fuel supply system, upstream of the pistons. During high-speed operation, the quantity of low pressure feed fuel pressurized by the pumping pistons is regulated and all of the fuel discharged from the pistons is delivered to the common rail.

21 Claims, 14 Drawing Sheets

HYBRID CONTROL METHOD FOR FUEL PUMP USING INTERMITTENT RECIRCULATION AT LOW AND HIGH ENGINE SPEEDS

This application is a C-I-P of U.S. application Ser. No. 09/913,661 filed Dec. 5, 2001, now U.S. Pat. No. 6,422,203, as the National Phase of PCT/US00/04096 filed Feb. 17, 2000 with priority under 35 USC §119 (e) from U.S. application Ser. No. 60/120,546 filed Feb. 17, 1999, and the benefit under 35 USC §119 (e) of U.S. application Ser. No. 60/318,375 filed Sep. 10, 2001.

BACKGROUND OF THE INVENTION

The present invention relates to fuel pumps, particularly of the type for supplying fuel at high pressure for injection into an internal combustion engine.

Typical gasoline direct injection systems operate at substantially lower pressure level when compared, for example, direct injection diesel fuel injection systems. The amount of energy needed to actuate the high-pressure pump is insignificant in the total energy balance. However, in a system with a constant output pump and variable fuel demands all of the unused pressurized fuel has to be returned into the low-pressure circuit. A good portion of the energy originally used to pressurize the fuel is then converted into thermal energy and has to be dissipated. Even a relatively modest heat rejection (200–500 Watt) will result in fuel temperature increase (especially if the fuel tank is only partially full) and this will further worsen problems resulting from low vapor pressure of a typical gasoline fuel.

A variable output high-pressure supply pump would thus be very desirable. Furthermore, the speed range of typical gasoline engines is substantially wider than that of diesel engines (e.g., from 500 RPM at idle to 7000 RPM or higher at rated speed). With variable pumping pressure achieved, for example, with a demand controlled pump, it would be easier to optimize the injection rate at any engine speed.

Current mainstream demand control strategies use a fast solenoid controlled valve to spill fuel from the internal high-pressure circuit back into the pump sump during the time when no fuel addition into the rail is desired. The internal high-pressure circuit is separated from the rail by a no return check valve. As the volume of this circuit is relatively small, after initial pressure drop, the rest of the fuel quantity supplied by the pump is spilled at a relatively low pressure (if desired it can be as low as just above the feed pump pressure). Because of that the heat rejection of such a system is much lower, compared to a system constantly spilling pressurized fuel (i.e., constant output pump with spilling rail pressure regulator.) However during high-speed operation even this lower heat rejection might not be acceptable as it could cause excessive temperature increase.

Several other configurations for a demand-based direct injection gasoline supply pump are shown and described in U.S. patent application Ser. No. 09/342,566, filed Jun. 29, 2999 for "Supply Pump For Gasoline Common Rail", now U.S. Pat. No. 6,345,609, and International application PCT/US00/04096 published as WO/0049283, the disclosures of which are hereby incorporated by reference. The present invention can be considered as particularly well suited for implementation in one or more of the embodiments shown in these publications, as well as variations thereof. In particular, the present invention is an improvement to the variable output control concept described in said International publication, for further decreasing the unproductive heat energy to be rejected.

SUMMARY OF THE INVENTION

The invention can broadly be considered as a hybrid method for controlling a common rail gasoline fuel injection system having a high pressure supply pump to the common rail, wherein the improvement comprises the combination of low speed control by recirculating the excess pump discharge flow to the fuel tank or through the pump inlet at a pressure lower than the rail pressure, and high speed control by premetering or prespilling.

In the preferred embodiment, the unwanted fuel at high speed is spilled out of the pumping chambers, before the high pressure is generated in the first place. This not only has the benefit of reduced heat rejection, but the additional benefit of a gradual pressure increase during the spill valve closing. As a result, any vapor cavities created during the restricted charging will implode at a slow rate before the high pressure pumping starts, resulting in lower noise and less likelihood of cavitiation erosion. Also, the spill valve will be closing against gradually increasing pressure and by that it will be potentially faster, or else the same value speed can be realized with lower magnetic force. With the spill occurring only after the natural end of pumping, the duty cycle can be extended in order to be easily controllable, even at maximum speed. Furthermore, the valve opening speed is not relevant at high engine speed, as the pumping event already ended with the piston reaching top dead center (TDC). Thus, the valve can be optimized for the closing event by using a weaker return spring, or the magnetic force can be generally reduced, resulting in a smaller and less expensive solenoid valve and associated control circuit.

The invention may be better understood in the context of a gasoline fuel injection system for an internal combustion engine, having a plurality of injectors for delivering fuel to a respective plurality of engine cylinders and a common rail conduit in fluid communication with all the injectors for exposing all the injectors to the same supply of high pressure fuel. An electronic engine management unit includes means for actuating each injector individually at a selected different time, and for a prescribed interval, during each cycle of the engine. A high pressure fuel supply pump having a high pressure discharge passage is fluidly connected to the common rail, and to a low pressure feed fuel inlet passage. The method and associated system establish at least two control regimes corresponding to respective low and high engine speeds. During low speed operation, unregulated low pressure fuel is fed to the pumping pistons, and the common rail is intermittently isolated from the pump, such that during the isolation, fuel discharged from the pump is diverted to a location of relatively low pressure in the fuel supply system, upstream of the pump. During high speed operation, the quantity of low pressure fuel pressurized from the pumping pistons, is regulated, thereby reducing the quantity of highly pressurized fuel delivered to the common rail.

A first, low speed control subsystem controls the discharge pressure of the pump between injection events, by diverting the pump discharge so that instead of delivery to the common rail, the flow recirculates through the pump at a lower pressure. This is preferably accomplished by a recirculation control passage fluidly connected to the low pressure feed fuel inlet passage, a discharge control passage fluidly connected to the high pressure discharge passage, and a non-return check valve in the high pressure discharge passage, between the discharge control passage and the common rail, which opens toward the common rail. A control valve is fluidly connected to the recirculation control passage and to the discharge control passage, and switch means are coordinated with the means for actuating each injector, for operating the control valve between a substantially closed position for substantially isolating the recirculation control passage from the discharge control passage and a substantially open position for exposing the recirculation control passage to the discharge control passage.

A second, high speed control subsystem for regulating feed quantity can be implemented in a variety of ways including a calibrated orifice, a proportional solenoid valve, pre-spilling, or pre-metering. In the preferred embodiment, the same solenoid valve used for the intermittent diversion or recirculation of pump discharge at low pressure is utilized at a different point in the timing cycle, to effectuate pre-spill for the high speed control regime.

The invention may also be considered a method for controlling the operation of a high pressure common rail direct gasoline injection system for an internal combustion engine having a continuously operating high pressure fuel pump to receive feed fuel at a low pressure and discharge fuel at a high pressure to a check valve which opens to deliver high pressure fuel to the common rail. During low speed operation, after each injector actuation an hydraulic control circuit is opened upstream of the check valve, whereby the pump discharge passes through the control circuit instead of the check valve, at a decreased pressure from the high pressure to a holding pressure between the high pressure and the feed pressure. While the pump discharge passes through the control circuit but immediately before each injector actuation, the hydraulic circuit is substantially closed whereby the pump output pressure rises from the holding pressure to the high pressure. When the pump output pressure reaches the high pressure an injector is actuated. At high engine speed, one or more of the previously mentioned quantity regulating techniques is implemented for quantity control of the fuel that is actually pumped at high pressure.

The major advantages of this control strategy are the control simplicity and quiet operation (acoustic and hydraulic noise) as well as torque uniformity at low speeds, where the driver's perception will be most sensitive.

It should be appreciated that the two control regimes may be distinct, i.e., the control passes from one regime to the other through a transition zone at a transition speed, or the control regimes may be super imposed, i.e., low pressure recycling of excess fuel may continue at higher speed after the transition speed is reached such that for at least some of the higher speed conditions, both low pressure recycling and regulated feed quantity to the pumping chambers occur simultaneously.

BRIEF DESCRIPTION OF THE DRAWINGS

The preferred embodiments of the invention will be described below with reference to the accompanying drawings, in which.

DESCRIPTION OF THE PREFERRED EMBODIMENTS

Figure 1:
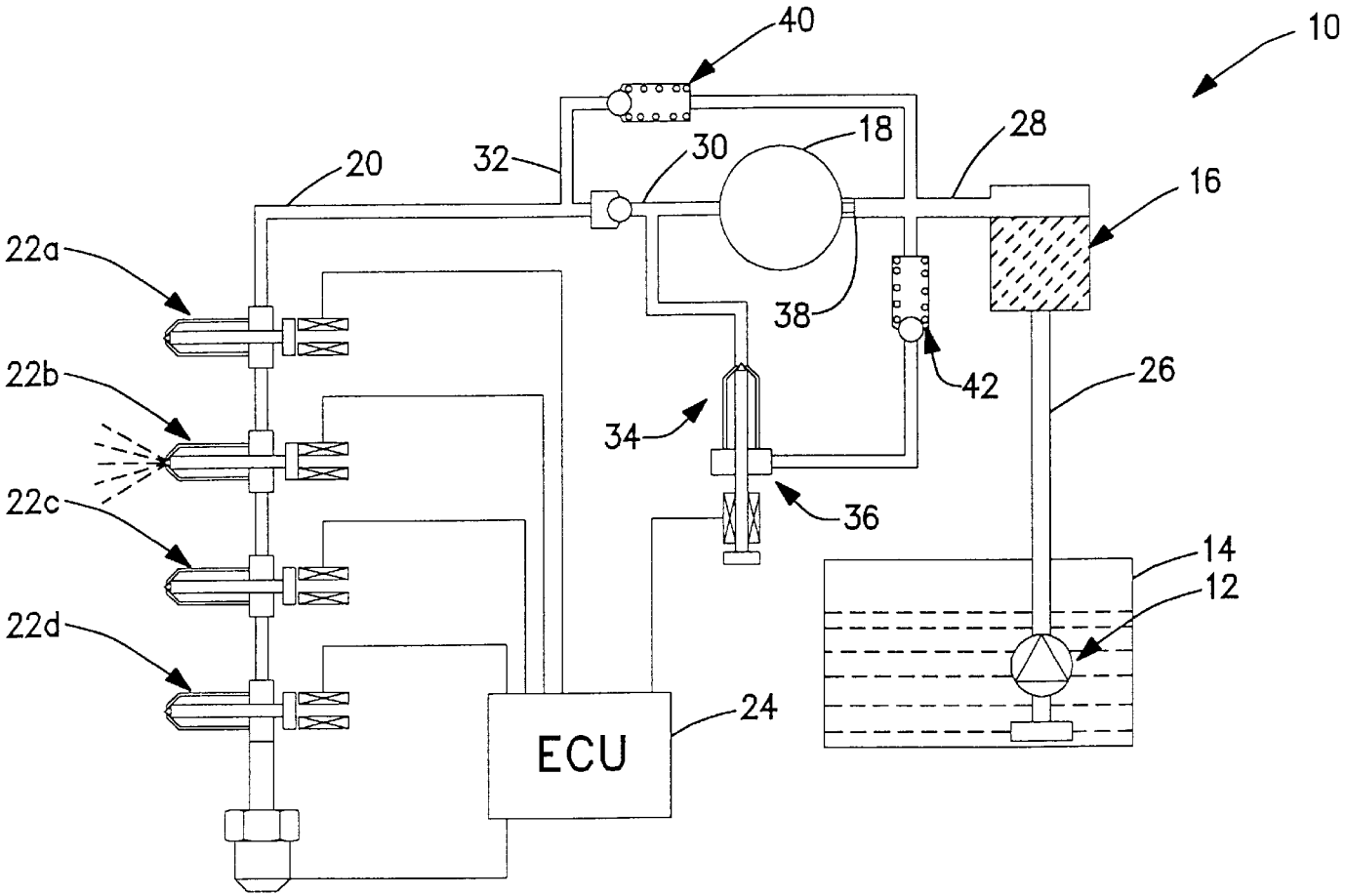
FIG. 1 is a fuel delivery system schematic incorporating one embodiment of the present inventions, wherein at low speed operation, a solenoid control valve can intermittently re-circulate fuel discharged from the pump at low pressure, whereas at high speed operation, feed fuel delivery to the pumping chamber is regulated by a flow control orifice.

FIG. 1 is a schematic of the fuel supply system 10 having the basic components of a low pressure feed pump 12 situated in a fuel tank 14, a fuel filter 16 upstream of a high pressure fuel supply pump 18 that maintains high operating pressure in a common rail 20 to which are fluidly connected a plurality of fuel injector nozzles 22A–D. As is conventional, the fuel supply pump 18 is driven by the vehicle engine, (i.e., the drive shaft of the pump rotates synchronously with the engine rotation such that the speed of the pump is proportional to the speed of the engine), and each nozzle is situated in the engine to inject fuel to a respective engine cylinder, in accordance with a timing sequence under the control of the fuel management electronic control unit 24.

The feed pump 12 delivers fuel at a relatively low pressure (under 5 bar, typically 2–4 bar) through feed line 26 to the filter 16, from which the low pressure fuel enters the pump via inlet passage 28. The pump discharges fuel through discharge passage 30, through a no return check valve 32, to the rail 20. The rail pressure is normally maintained above 100 bar but, as mentioned in the background, the quantity of fuel required to maintain the target operating pressure in the rail 20, is not always commensurate with engine (and thus pump) speed.

According to the invention, a demand based control scheme is implemented, according to which low speed operation fuel is fed to the pump through the inlet passage 28 without regulation, but the fuel discharged in line 30 is intermittently isolated from the common rail 20 to a location of relatively low pressure in the fuel supply system. In the illustrated embodiment, this is implemented by a low pressure bypass circuit 34, preferably implemented internally of the pump casing or housing. In particular, the bypass circuit 34 is fluidly situated upstream of the check valve 32 at one end for receiving discharge flow from pump 18, and is fluidly connected at the other end to the inlet passage way 28 upstream of the pump 18, with a mass control valve 36 in the circuit, for diverting excess fuel discharge from the pump to the low pressure at the pump inlet line 28. Alternatively, the low pressure discharge could be to the fuel tank 14.

During high speed operation, the quantity of low pressure feed fuel to be pressurized by the pumping pistons is regulated, so that the quantity of high pressure fuel actually delivered to the common rail correspond to the quantity needed for maintaining the target rail pressure. This is accomplished in the illustrated embodiment, by the presence of a flow control orifice 38 in the pump inlet passage way 28 (downstream of the fluid connection of the bypass circuit 34 to the inlet passage 28).

Optional features of the demand control system as shown in FIG. 1, include an over pressure safety valve 40 fluidly connected down stream of the check valve 32 to a low pressure location in the fuel system such as the inlet passage way 28, for relieving very high pressure in the common rail 20, apart from the normal control scheme. Also, a minimum pressure regulator 42 can be situated in the bypass circuit 34, between the control valve 36 and the fluid connection to the inlet passage way 28, to assure that the fuel pressure in the pump itself stays above a minimum that would otherwise be prone to cavitation or the like, and to reduce the separation between two adjacent pumping circuits and also to provide minimum injection pressure for emergency "limp home" operation.

Figure 2:
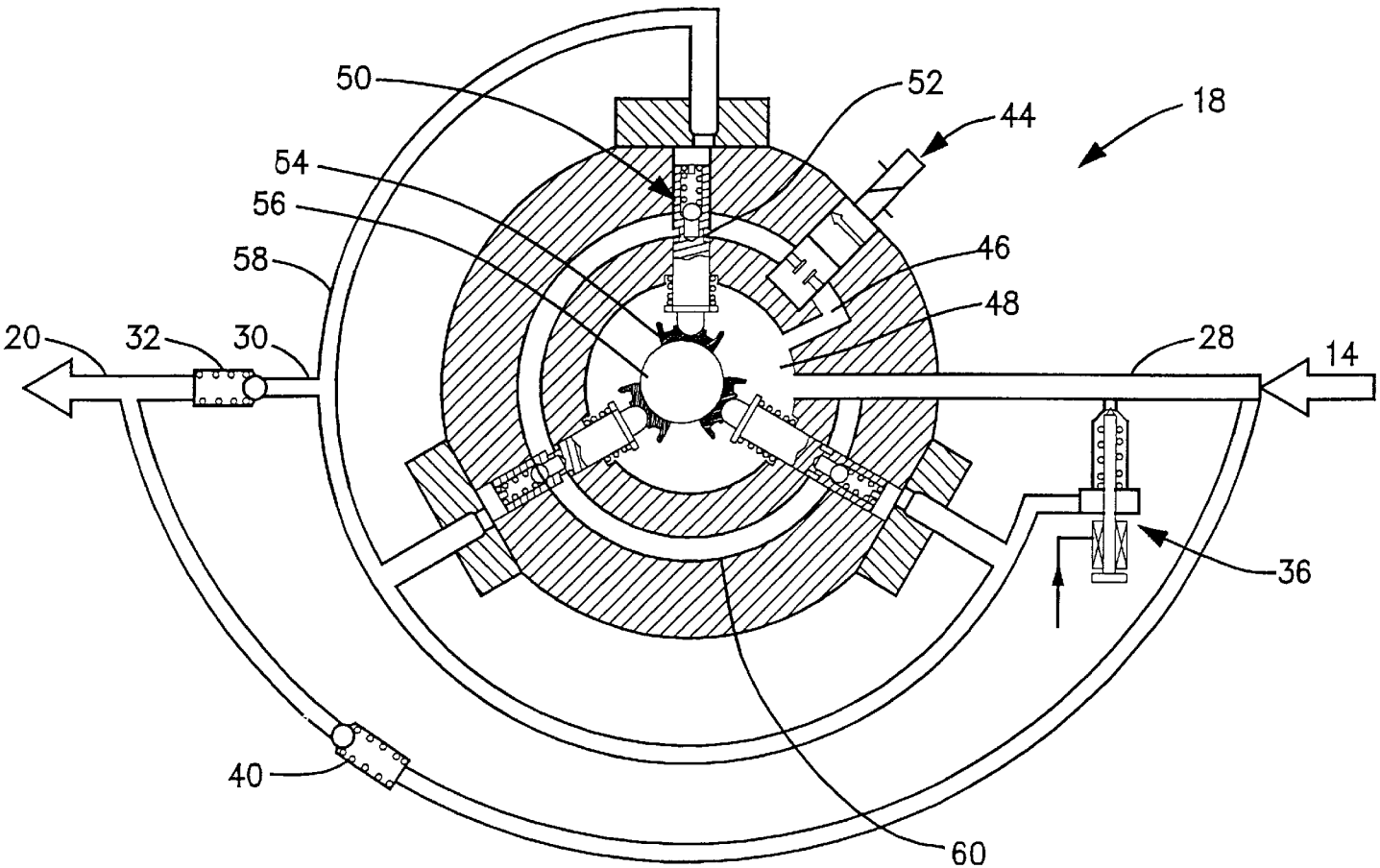
FIG. 2 is a schematic of a high pressure pump for implementing a modified control scheme, whereby at low speed operation a solenoid valve intermittently re-circulates fuel discharged from the pump at low pressure, whereas during high speed operation, fuel delivery to the pumping chamber is regulated by the combination of a calibrated flow control orifice and a proportional solenoid valve.

FIG. 2 shows another embodiment of the invention, in a different form of schematic, with the pump 18 situated between the inlet flow along inlet passage 28 from pump 14, and the discharge line 30 through check valve 32 to the common rail 20. In this embodiment, the high pressure of the high-speed control regulation of the feed flow is achieved by passing the feed fuel through an adjustable inlet flow restrictor. In particular, a proportional control solenoid valve 44 is situated to receive flow via passage 46 from the feed fuel in sump 48, thereby influencing the fuel pressure in the internal charging circuit 60. The plurality of radial pistons 50 actuated by the pump drive shaft 56 via pumping shoes 54 (as is known) include flow orifices 52 in the piston walls for supplying the feed fuel to the pumping chamber. Each piston pumps the quantity of fuel delivered therein, to the high-pressure circuit 58 for delivery through discharge passage 30 to the rail 20. It can be appreciated that, at high engine speed, the combination of proportional solenoid 44 and calibrated orifices 52 can provide the required quantity of regulated fuel, for maintaining a constant pressure in the rail.

For control at low speed operation, the mass control valve 36 corresponding to that shown in FIG. 1 is connected to the high-pressure circuit 58 upstream of the check valve 32, as well as to the low pressure inlet passage 28, for intermittently re-circulating fuel at low pressure. Also shown is the over pressure safety valve 40 connected between the discharge passage down stream of check valve 32, and the low pressure feed passage way 28.

Figure 3:
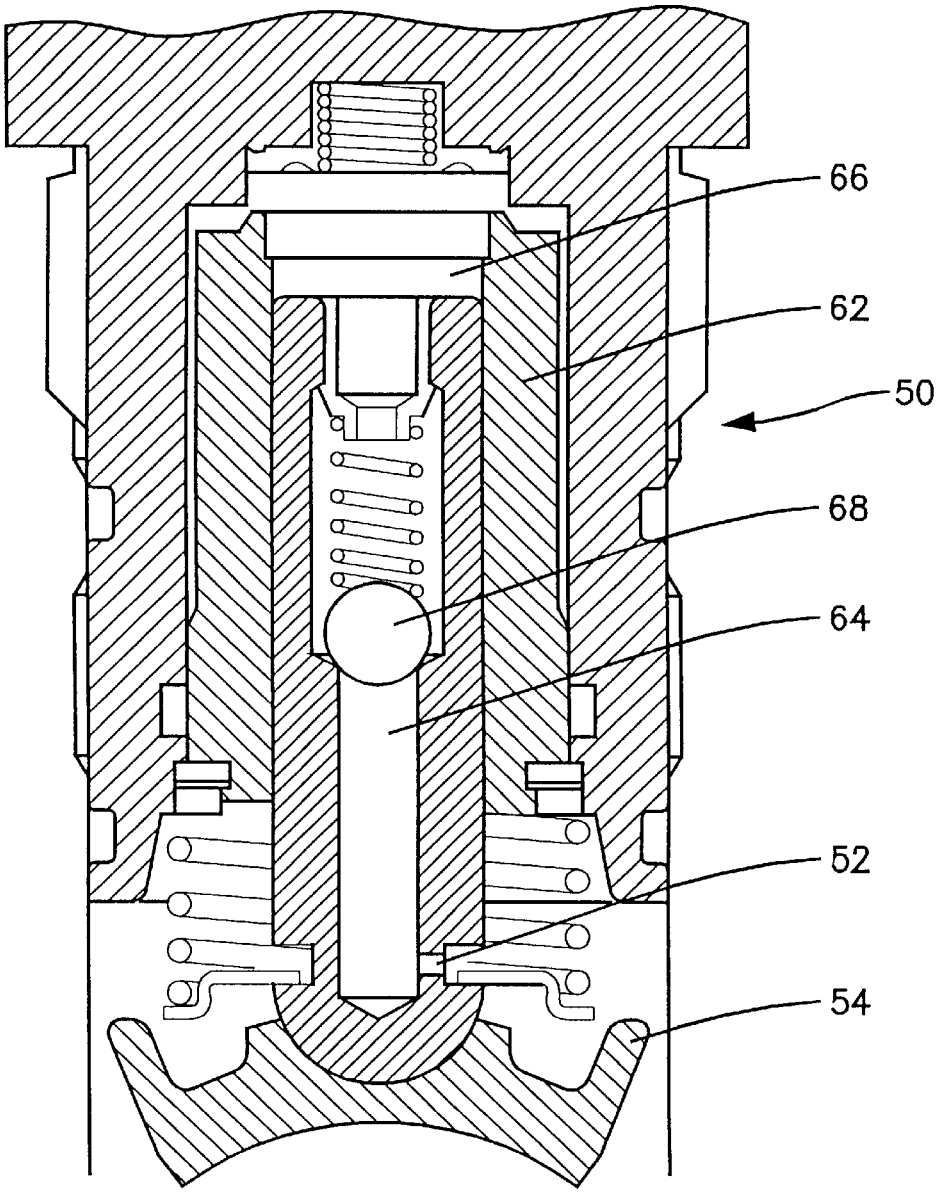
FIG. 3 is a cross section view of a pumping plunger configuration usable in the embodiment of either FIG. 1 or FIG. 2, with the flow control orifice incorporated into the pumping plunger wall.

FIG. 3 shows the detail of the preferred pumping plunger or piston assembly 50 including a piston wall with associated orifice 52 with passage 64 leading to the pumping chamber 66 under the control of spring loaded check valve 68. The inlet flow path for each pumping plunger upstream of the inlet check valve 68 is restricted by the calibrated orifice 52 to only allow charging of fuel quantity just above the WOT quantity at the maximum (rated) speed. The preferred shoe is adapted to address a problem which arises during partial filling under the high pressure control mode of operation, due to a first component originating from the pressure drop across the piston inlet (metering orifice plus opening pressure from the inlet check valve) acting over the affective area of the piston, trying to counteract the piston return spring force. If the shoe separates from the eccentric drive (not shown) an excessive distance, the shoe could become so misaligned as to lose engagement with the bull on the piston and disengage, to be carried by hydraulic forces into the gap between the pump housing and the shaft, resulting in a catastrophic damage of the pump. The shoe 54 has a projecting, segmented rim or the like, forming multiple separated guide elements that keep the shoe in the piston bore and minimize hydraulic forces caused by the axial motion of the shoe. As a result of the separated guide elements (castellation), the shoe is guided within the pumping bore (i.e., pumping chamber mounting bore), so that it not only prevents the shoe from leaving the mounting bore, but also ensures that the ball at the end of the piston finds its socket as the eccentric drive traverses its full rotation.

Figure 4:
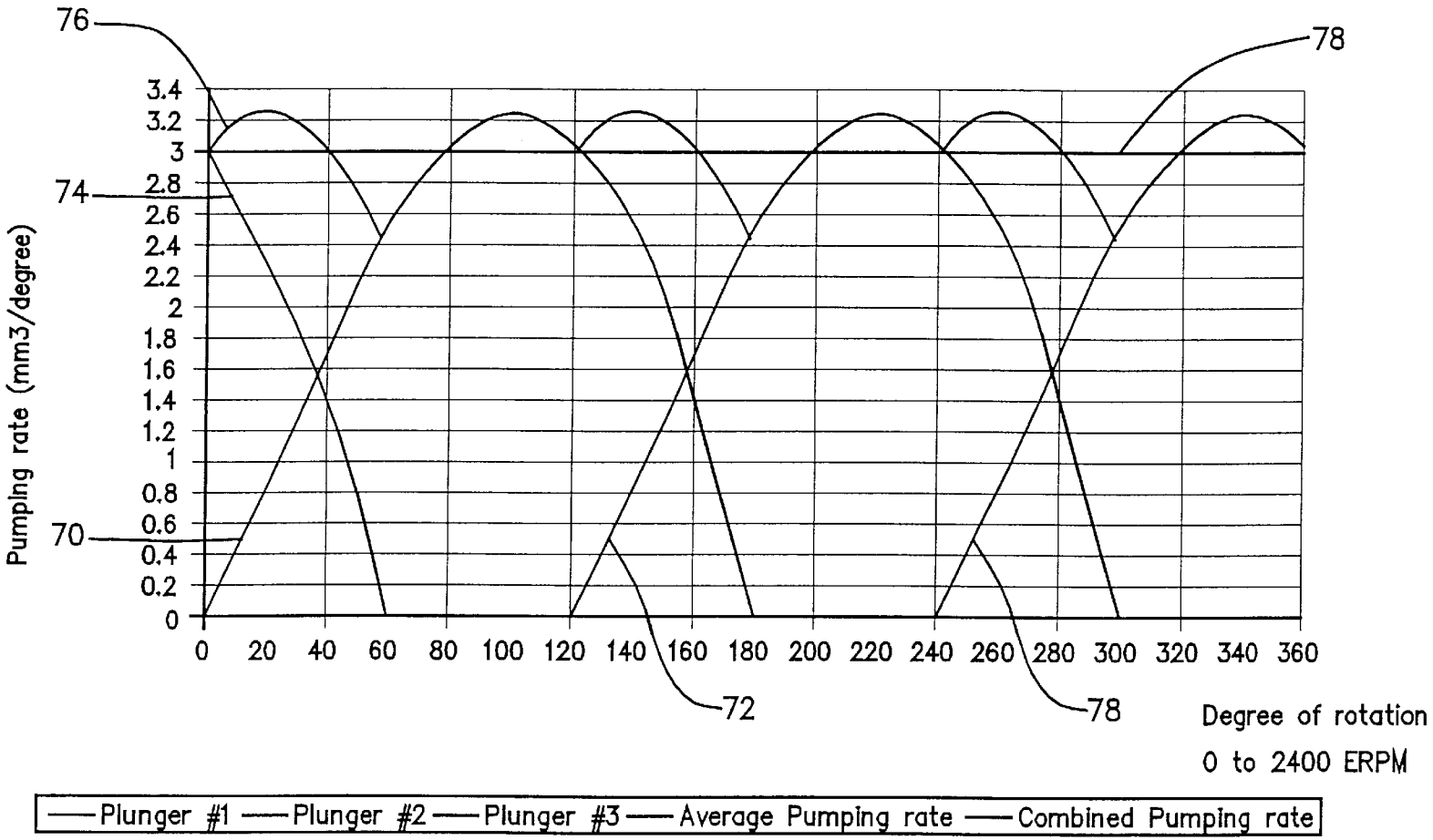
FIG. 4 is a graph showing the instantaneous pumping rate for each of three pumping plungers and the associated combined pumping rate and average pumping rate, as a function of degree of rotation of the pump drive shaft to produce a pump output of about 1,000 mm3/rev at low speed operation of 0 to 2400 erpm.

Because of incomplete charging the pumping characteristic of the pump will change from typical continuous (overlapping) appearance (FIGS. 4 and 5) into three distinct pumping events per revolution (FIGS. 6–12). Due to high injection frequency at elevated speeds, the demand solenoid control valve should be synchronized with every other injection event, resulting in three control events per pump revolution. In FIG. 4, the operation of each of three plungers is shown by curves 70, 72 and 74, respectively. The combined pumping rate is shown by curve 76 and the average pumping rate is shown by curve 78. The start-up pumping is at zero degrees, resulting in a pump output of approximately 1000 mm3/rev. Start-up pumping is determined by the size of the inlet orifice in the pumping pistons (see 52 in FIG. 3) and by the speed. The relationship depicted in FIG. 4 represents unrestricted inlet flow (e.g., 0.09 diameter passage) at all engine speeds and restricted flow (e.g., 0.03 diameter orifice) flow at low engine speed (e.g., up to 2400 rpm).

Figure 5:
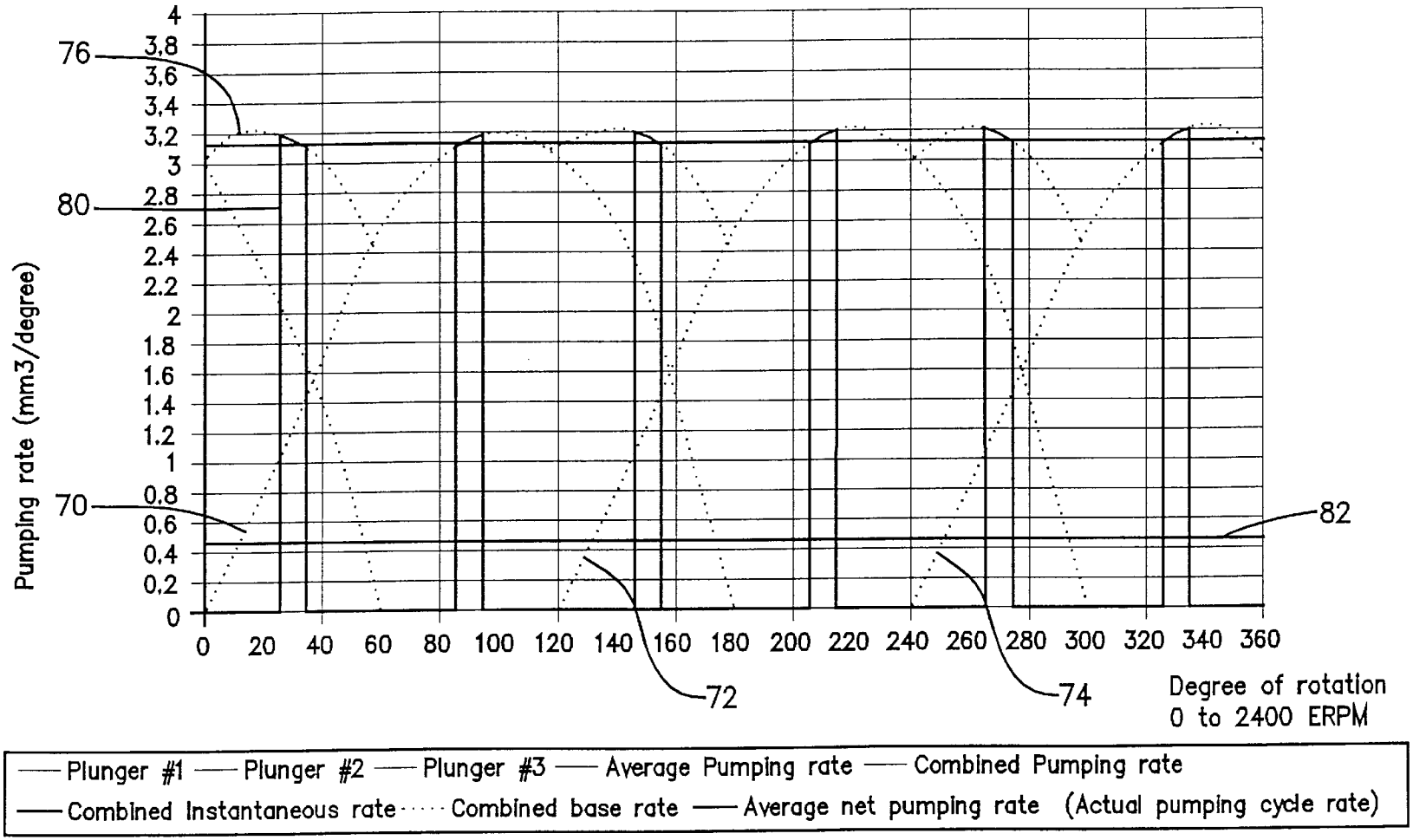
FIG. 5 is a graph similar to FIG. 4, except that the effect of intermittent re-circulation at low pressure by means of a solenoid valve energized between injection events at a duty cycle of about 13%, is superimposed thereon, showing the result that the high pressure output of the pump has been reduced to about 157 mm3/rev.

Low-pressure by-pass during low and intermediate speeds is illustrated in FIG. 5. In FIG. 5, the spikes 80 represent the combined instantaneous pumping rate deliverable to the common rail, during the period of time when the control valve 36 (see FIG. 1) is closed, whereas, during the remainder of the cycle, the control valve is open and the pump discharge flow is recirculated at low pressure. The equivalent inlet flow diameter is 0.03, which is unrestricted during the low speed control operation depicted in FIG. 5. The average pumping rate shown on line 82, is 157 mm3/rev. This control strategy can be synchronized with every or every-other injection. The main advantage of this strategy is that it is controllable down to the lowest speed, as opposed, for example, to inlet metering, where a 1% change in duty cycle changes pump output from 10 to 100% at less than 1000 RPM.

If the pump is timed relative to the engine in such a way, that the start of valve opening coincides with the natural end of pumping of each individual pumping chamber, the same spill valve can be used in two different control strategies during the pump operation.

Figure 6:
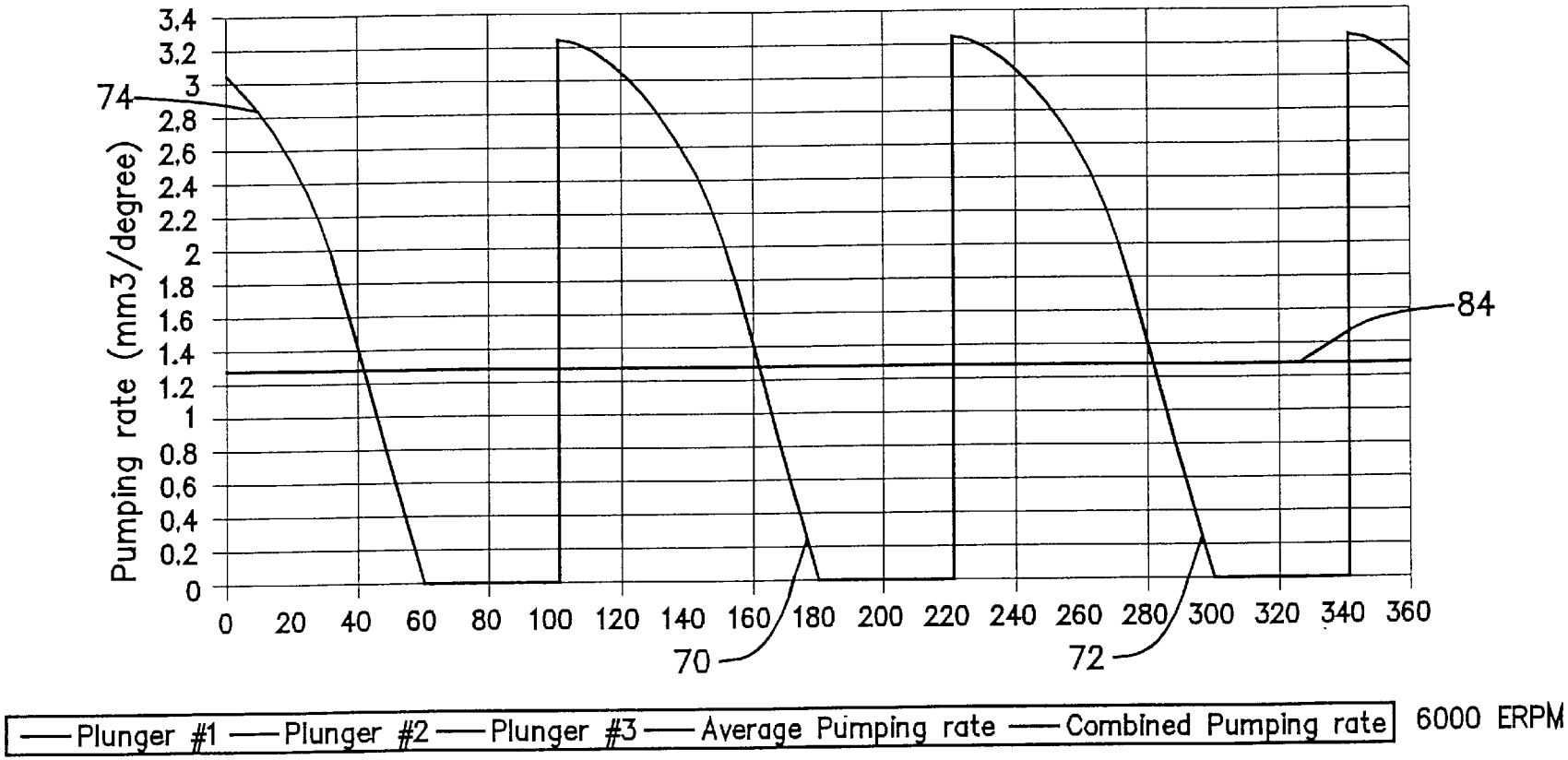
FIG. 6 is a graphic representation of the natural pumping characteristics of fuel quantity pumped at high pressure at high speed operation, wherein operation is at wide open throttle and 6000 ermp, with the regulating control valve operating at 100% duty cycle (always closed) to deliver about 421 mm3/rev.
Figure 7:
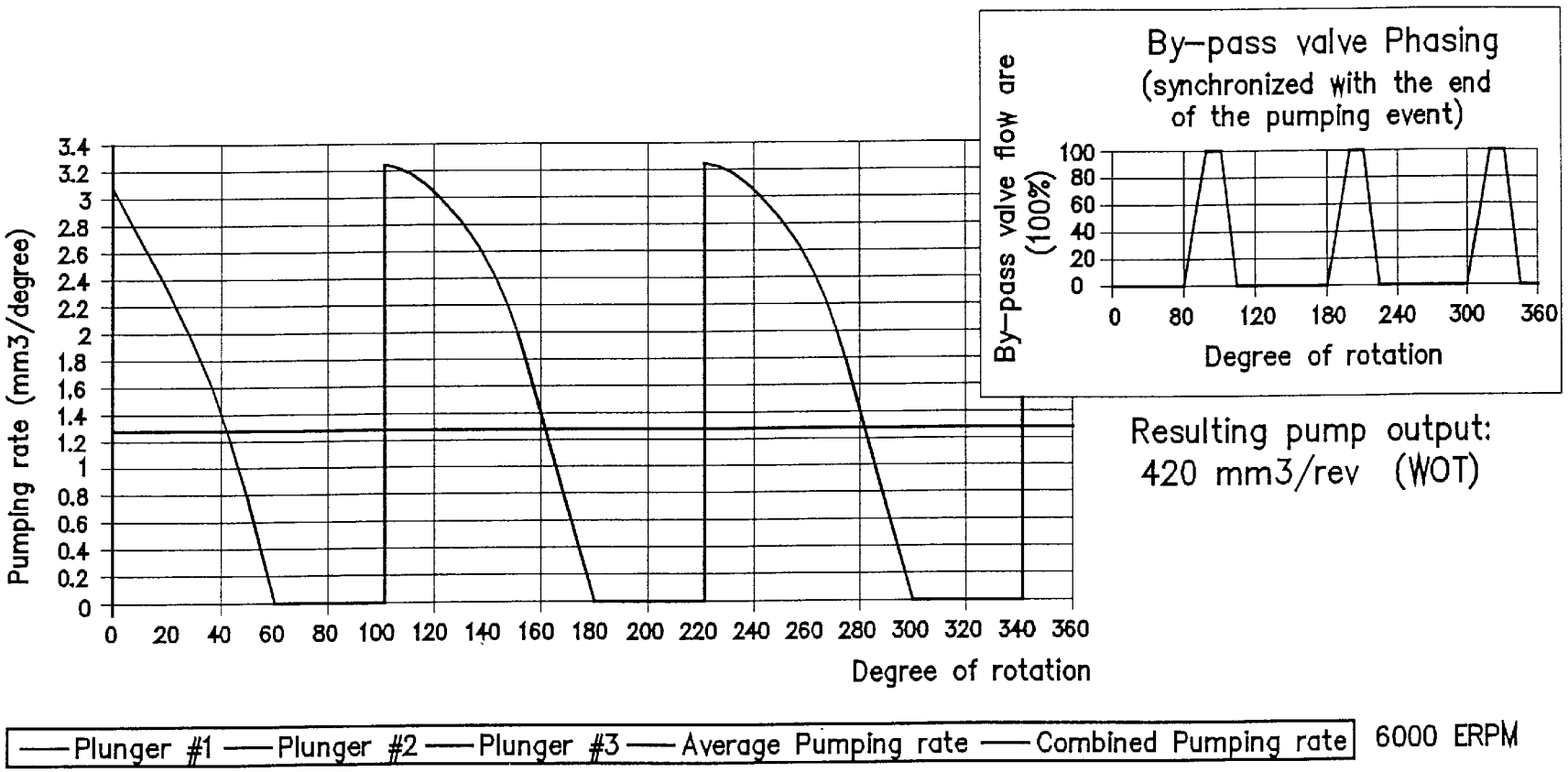
FIG. 7 is a graph similar to FIG. 6 showing the effect of actuating the high speed control valve at 75% of duty cycle at wide open throttle at 6000 rpm, with no change in the average pumping rate of 421 mm3/rev.
Figure 8:
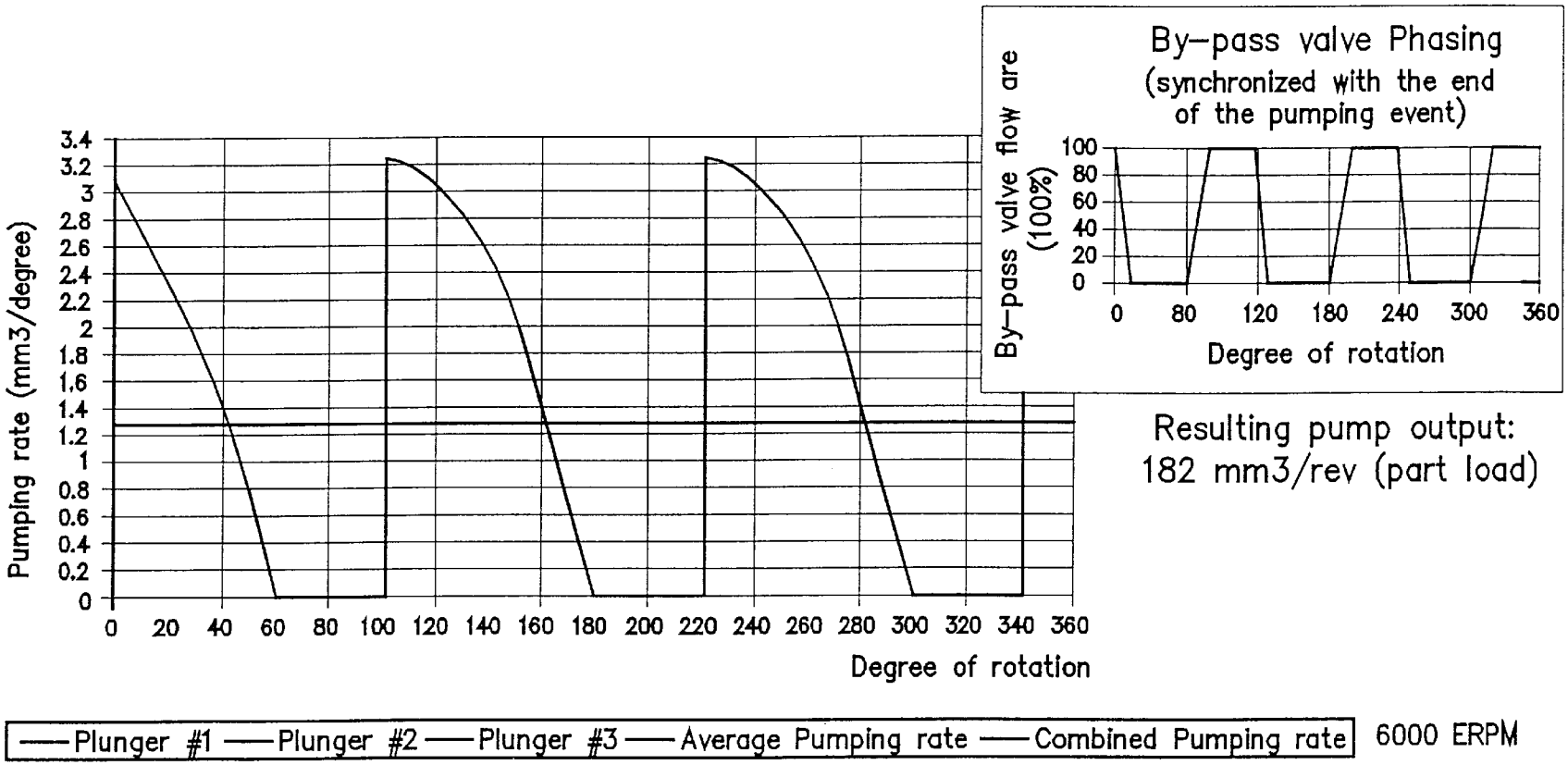
FIG. 8 is a graph similar to FIG. 7 showing operation at 6000 erpm and a duty cycle of 37.5% on the control valve producing a pump output of about 182 mm3/rev corresponding to part load.
Figure 9:
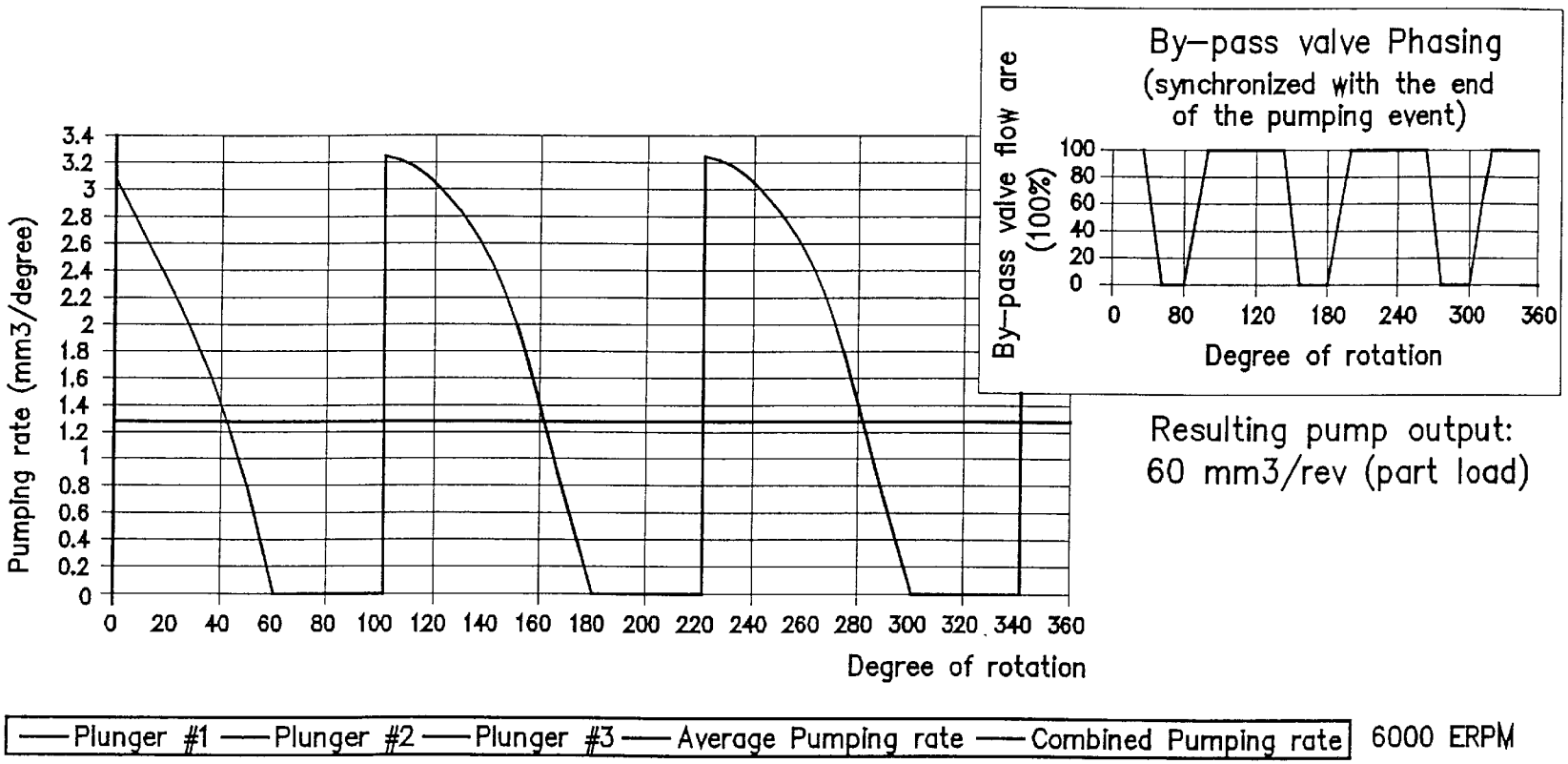
FIG. 9 is a graph similar to FIG. 8, showing the control valve operating at 33% duty cycle at 6000 erpm, resulting in a pump output of 60 mm3/rev (high idle).
Figure 10:
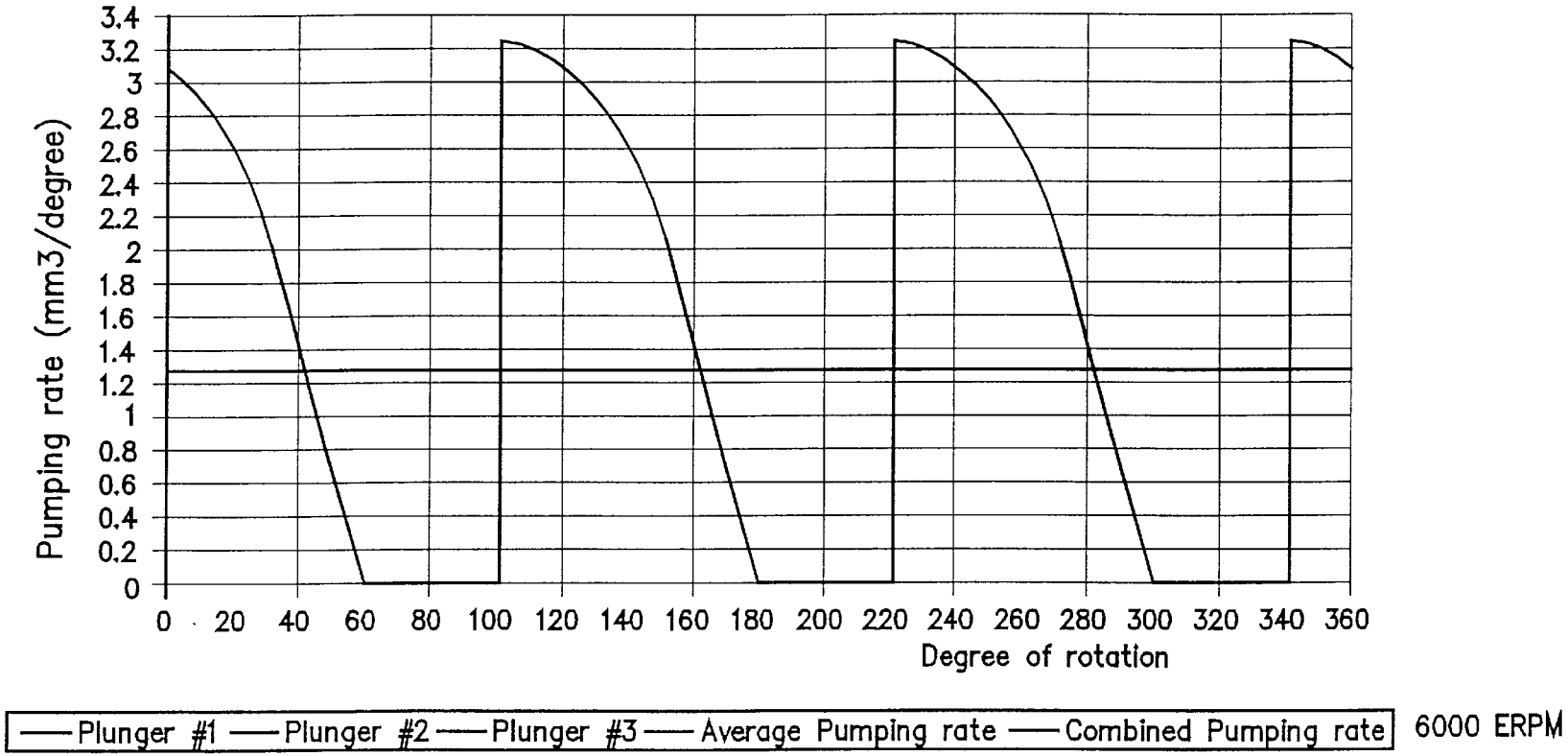
FIG. 10 shows the pumping rate characteristics at 483 mm3/rev for a decrease in speed to 5000 erpm, relative to the wide open throttle operation at 6000 erpm shown in FIG. 6.
Figure 11:
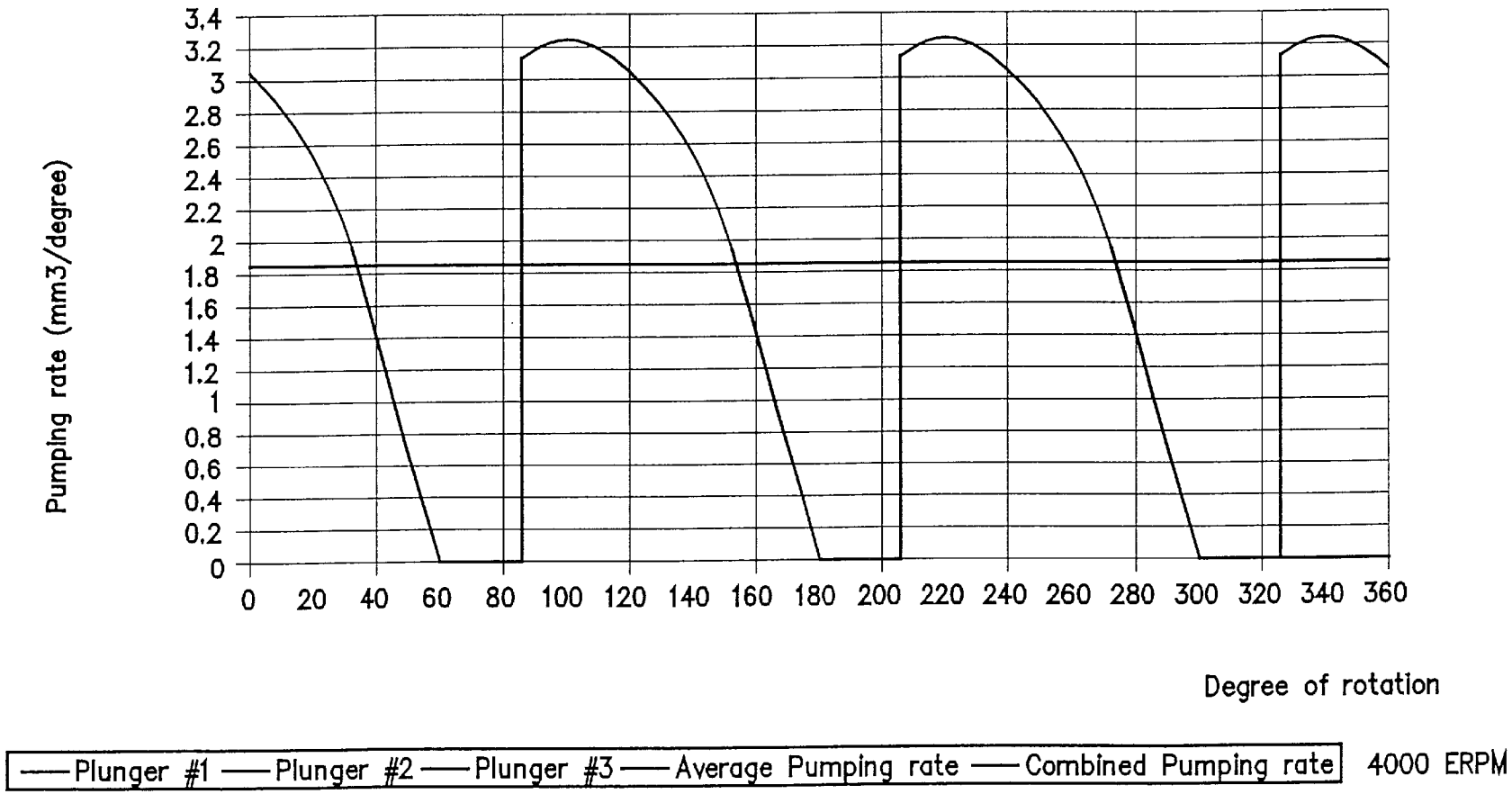
FIG. 11 shows the pumping rate characteristics of 606 mm3/rev for a decrease in speed to 4000 erpm, relative to the 5000 erpm shown in FIG. 10.
Figure 12:
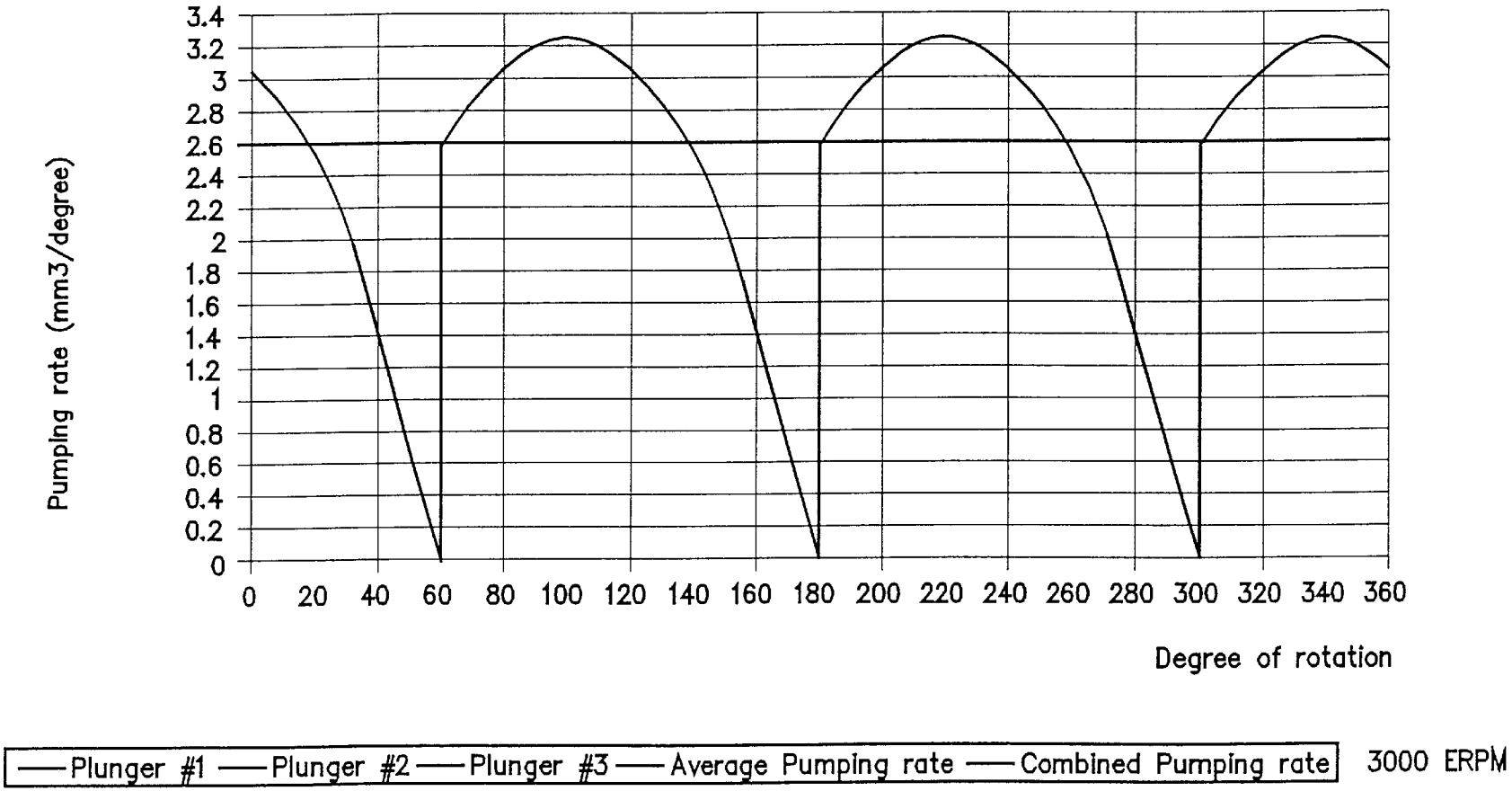
FIG. 12 shows a graph of the pumping rate characteristics 798 mm3/rev with a decrease in speed to 3000 erpm, relative to the 4000 erpm shown in FIG. 11.

Pre-spill control at highest speeds, is illustrated in FIGS. 6–9. FIG. 6 shows the natural characteristics of the pump at 6000 rpm. In FIGS. 7–9, as a result of the pre-spill, the pumping rate associated with plunger number one having less than a full volume of fuel charge, such that no fuel is pumped during the rotation from 0 to about 106 degrees, whereas pumping begins at about 106 degrees and terminates at 180 degrees. This same pattern is also evident for the second piston represented by curve 72 and the third piston represented by curve 74. The average pumping rate is represented at line 84, showing the resulting pump output of about 421 mm3/rev. The equivalent inlet flow diameter is 0.03. FIG. 7 shows the by-pass valve opening phase synchronized with the natural end of the pumping event (see also FIG. 6). During WOT operation the solenoid valve can either be kept closed indefinitely or if this is not possible due to excessive heat generation, operated at a duty cycle slightly longer than the natural pumping cycle determined by restricted charging. Another option is to extend the beginning of the natural pumping cycle and actuate the spill valve at a shorter duty cycle, so that the valve closing will determine the pump output.

FIG. 8 is similar to FIG. 7 but with by-pass valve phasing such that the resulting pump output is 182 mm3/rev, corresponding to part load, at 6000 erpm. It can be appreciated that as between FIG. 7 and FIG. 8, the by-pass valve phasing shows a larger duration of by-pass valve flow in FIG. 8 (corresponding to part load) relative to the by-pass flow of FIG. 7 (WOT). FIG. 9 is similar to FIG. 8, showing an even greater duration of by-pass valve phasing to produce a pump output of 60 mm3/rev, corresponding to high idle at 6000 erpm. In this case the unwanted fuel is spilled out of the pumping chambers, (E.g. 66 per FIG. 3) before the high pressure is generated in the first place.

The relationship of the bypass valve phasing illustrated in the small graphs in FIGS. 7, 8 and 9, with the maximum pump output at the particular speed, is further illustrated in the composite graph discussed below with respect to FIG. 14.

In addition to the benefit of reduced heat rejection there is an additional very important benefit: there will be a gradual pressure increase during the spill valve closing and because of that the vapor cavities created during the restricted charging will implode at a lower pressure before the high pressure pumping started, resulting in lower noise and less likely cavitation erosion. Preferably the spill valve exhaust channel leads into the pressurized pump sump (typically 4 to 5 bar). Until the spill valve is fully closed, there will be a back fuel flow out of the pumping chamber and in order to establish this flow, the pressure in the pumping chamber must be above the sump pressure. Also, the spill valve will be closing against gradually increasing pressure and by that it will occur potentially faster or the same speed can be realized with lower magnetic force. With the opening occurring only after the natural end of pumping the duty cycle can be extended and/or delayed in order to be easily controllable, even at maximum speed. Furthermore, the solenoid valve opening speed is not relevant at these high engine speeds, as the pumping event already ended with the piston reaching TDC. Thus, the solenoid valve can be optimized for the closing event by using a weaker return spring, or the magnetic force can be generally reduced, resulting in a smaller and less expensive solenoid valve and its associated control circuit.

The pumping rate characteristics with declining speed are shown in FIGS. 10–13 and 4. As the speed decreases, the maximum fuel quantity the pump can supply gradually increases, following a characteristics shown on FIG. 13. At speeds below for example 2400 ERPM there will be no charging restriction and the pump will be able to supply the maximum fuel quantity. Thus, the maximum required fuel quantity at cranking is insured.

Figure 13:
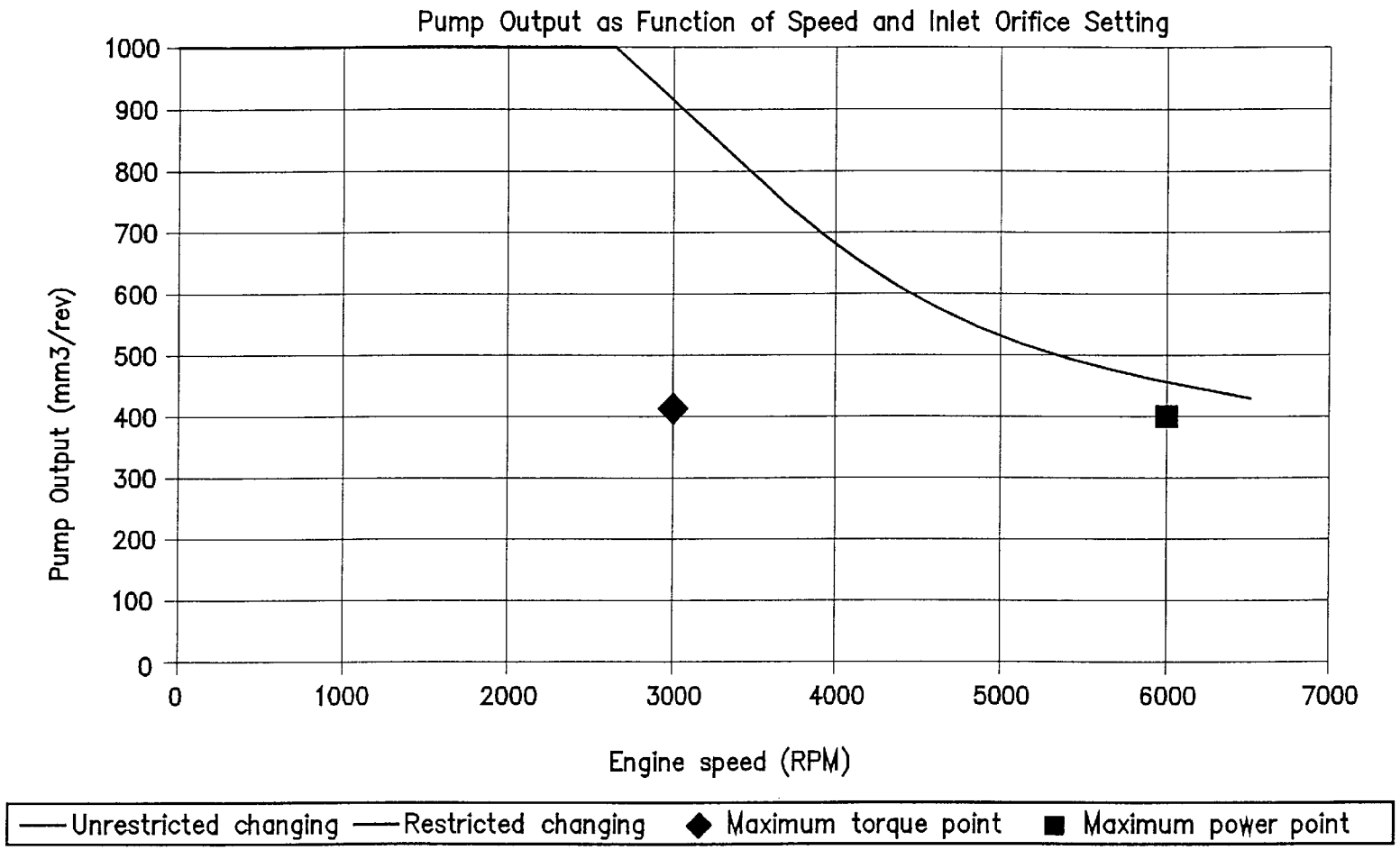
FIG. 13 shows the pump output as a function of speed wherein the pump output reduces with increasing engine speed due to restrictive charging, such as through an inlet orifice, that becomes effective to influence restricted charging at just under about 3000 erpm, whereby the pump output is reduced by over 50% at engine speed at 6000 erpm corresponding to wide open throttle.

In FIG. 13, one can draw the generalization that for an engine having a maximum power point at a particular engine rpm (e.g., 6000 erpm), and having a maximum torque at a lower erpm (e.g., 3000 rpm), the control strategy according to the invention has unrestricted charging at engine speeds from zero up to about the erpm for maximum torque, and then increasingly restricted charging from about the erpm for maximum torque, to the erpm for WOT. This can be restated based on FIG. 13, to the effect that for a pump speed corresponding to WOT, pump charging is unrestricted for a low speed control regime up to approximately one half the erpm at WOT, whereas at higher erpm the charging is increasingly restricted up to WOT. In a typical implementation where the engine speed varies from zero to up to about 7000 erpm, the transition from unrestricted charging to restricted charging would occur at an erpm in the range of 2000–4000 rpm. Preferably, the restricted charging begins at an erpm slightly below the erpm corresponding to the maximum torque point. As an example, for an engine having a maximum power point at 6000 erpm and a maximum torque point at 3000 rpm, the transition from unrestricted to restricted charging would occur at about 2600 erpm.

Figure 14:
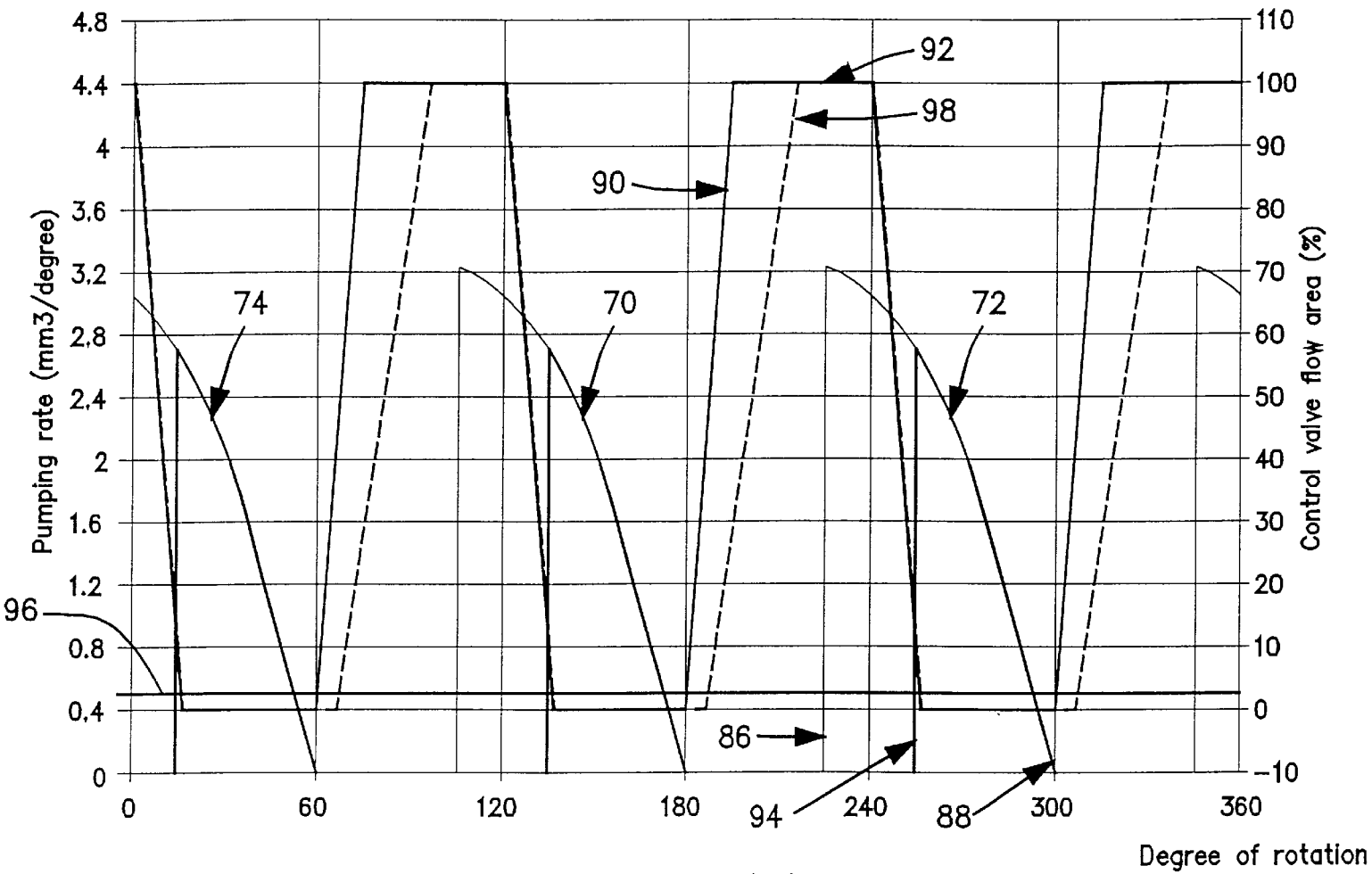
FIG. 14 is a composite graphic representation showing the relationship of spill valve phasing and maximum pump output associated with FIGS. 7, 8 and 9.

The way in which the demand control is implemented at high speed as represented in FIG. 13, based on the phasing illustrated, for example in FIGS. 7, 8 and 9, can be better understood with reference to FIG. 14. FIG. 14 corresponds to the condition shown in FIG. 8. Curves 70, 72, and 74 correspond to the respective curves 70, 72, and 74 shown in FIGS. 6–9, i.e., the maximum instantaneous pumping rate for each piston at an engine speed of 6000 rpm. In particular, curve 72 shows that the earliest possible start of pumping (determined by the amount of fuel present in the pumping chamber at the end of charging) as indicated at 86, begins at a degree of rotation less than 240 deg. and follows the curvature to end of pumping (i.e., the piston is in a top dead center position) at 300 deg. of rotation, as indicated at 88. With the bypass valve operated according to the pattern shown at 90, corresponding to early and fast valve opening, the control valve flow area percentage 92 begins at 0, rises rapidly to 100 percent where it remains for a substantial degree of shaft rotation, and then drops quickly to 0 at approximately 240 deg. of rotation. Fuel cannot be highly pressurized in the pumping chamber until the control valve is substantially closed and, accordingly, the actual start of pumping indicated at 94, corresponds approximately to the degree of rotation for the valve closure. It can be appreciated that the start of the valve opening in this particular example, at about 180 deg. of rotation, corresponding to the end of pumping of the previously active piston 70. Similarly, the valve is closed during the interval of approximately 240 deg. of rotation to approximately 300 deg. of rotation. The next early and fast rise of the valve opening curve begins at approximately 300 deg. of rotation, corresponding to end of pumping for piston 72 at 88. From this particular example, it can be appreciated that the restricted charging results in only a partial high pressure pump output quantity as represented by the average pumping rate 96, being less than 0.6 mm3/deg., whereas the average pumping rate at 6000 erpm with unrestricted inlet charging is approximately 1.3 mm/deg., as represented by line 84 in FIG. 6 (with the same rate also shown in FIGS. 7–9).

FIG. 14 also illustrates the effect of delaying and reducing the speed of bypass valve opening, indicated by line 98. According to that line, the valve opening is delayed a few degrees relative to the opening represented by curve 90, and thus the delay also opens the valve a few degrees after the end of pumping point at 88. The valve opening is also at a slower rate, and achieves full flow (100 percent) at a later degree than shown in curve 90. Nevertheless, the closing of the valve follows the same closure slope as indicated in curve 90. As can be appreciated by comparison of the bypass phasing curves in FIGS. 7, 8 and 9, a change in the shape of the bypass valve operational curve, will affect the time (measured in degree of rotation) at which the pumping chamber will have a "solid" slug of fuel without a bypass flow path available. Thus, by varying the control valve operation, the shape of the pumping rate curve can be modified to produce a high speed control behavior represented in FIG. 13, when combined with the further relationships represented in FIGS. 10–12.

It should be understood that variations of the invention relative to the preferred embodiment described therein, can fall within the spirit and scope of the appended claims. For example, it is possible to operate in a rail pressure based closed loop mode. In this case the valve will be operating with constant closing and variable opening. Restricted feed at high speed can be achieved by, e.g., pre-meter via calibrated orifice in the piston wall, proportional solenoid, adjustable flow restrictor, pre-spill to fuel tank, or pre-spill to pump inlet.

All of these methods could potentially be used in the hybrid control strategy, however with various degrees of effectiveness and also subjected to certain limitations and restrictions.

Pre-metering by the calibrated orifice in the piston wall is the best way to achieve the pumping event separation necessary for implementation of the hybrid control strategy. A proportional solenoid can be used to control the charging pressure, but it needs a separated charging circuit. Such separated charging circuit, consisting of proportional solenoid valve exhaust and channels leading to the calibrated orifices of the pumping pistons, would be necessary for two reasons: (1) to maintain sufficient pressure level in the sump of the pump and by that prevent formation of detrimental vapor cavities (lubrication of sliding components and resulting friction leading to temperature increase and wear), and (2) To achieve uniform distribution of fuel charges among the individual pumping chambers. Then the output of the pump at high speed can be controlled by modulation of charging pressure i.e., by inlet metering. However it would be difficult to also reliably control low output at low speeds. Because the control parameter determining the pump output is the charging pressure then the same effect can be achieved by feed pump (in-tank pump) pressure modulation.

A low pressure proportional solenoid in the inlet circuit, can only effectively control pump output at intermediate and high speed, because of the excessively coarse signal resolution (1% signal change=90% output change). A proportional solenoid located in the high pressure circuit to control rail pressure is less energy efficient, but at low speed the overall energy level is low and at high speed the energy level is reduced by the charging restriction and thus this control strategy is not only viable but also desirable, as long the heat rejection stays within acceptable limits.

As discussed above, hybrid control includes partial pre-spilling of pumping chamber content, already reduced by the charging restriction of the calibrated orifices in the pistons at intermediate and higher speeds, while at low speed the same actuation command will result in low pressure bypass featuring delayed spill valve closing at high speed (3000, 4000, 5000 and 6000 RPM) and intermittent valve closing and opening at lower speeds (0–2400 ERPM).). The timing can be arranged such that the same pulsed solenoid that effectuates low pressure recirculation in the low speed regime between injection events can also be used for pre-spill feed control in the high speed regime by operating the control valve between pumping cycles to regulate the quantity of low pressure feed fuel to the charging chamber of the pumping pistons and delivering all of the fuel discharged from the pump, to the common rail.

In the case of low pressure bypass it is difficult to distinguish pre- or after-spilling as the individual pumping chamber outputs overlap and because of that it is (from a pump global point of view) impossible to distinguish between start of pumping and end of pumping. It would be possible to consider start and end of pumping of each individual pumping chamber, but as all the chambers are connected and controlled by a single on-off solenoid valve it is more appropriate to refer to the valve intermittent closing and opening, that can be implemented at any time (randomly), although it is advantageous for pumping uniformity and resulting rail pressure pulsation to synchronize the control events with the natural pumping rate characteristic.

However, because of the inlet restriction by the calibrated orifice the pumping rate characteristic will change from continuous (overlapping) pumping into three distinct and separated pumping events (more pronounced the higher the speed). The pumping will start during the compression stroke, as soon as both of the following criteria are simultaneously met: piston moving toward TDC reached position when only solid fuel is present in the pumping chamber and spill valve is kept closed. By delaying the spill valve closure the output will be reduced by the amount of the fuel pre-spilled back into either the pump sump or into the tank. Which of these strategies will be ultimately implemented will depend on whether the amount of heat developed during pumping can be tolerated.

The pumping ends as soon as the piston reached the TDC and because of that it does not matter whether the solenoid valve is at that time closed. During the reduced output operation the spill valve must be opened during the initial compression stroke (to achieve pre-spilling) and thus the opening event has to occur sometimes between the end of pumping and the start of the compression stroke, but the exact time opening rate is not critical. Because the pumping event already ended and no after-spilling will take place the opening is likely to occur faster, compared to the "real" spilling event, as the hydrodynamic force acting across the valve seat tends to induce the valve to close. Furthermore, the large volume of spilled fuel trying to leave the low pressure chamber located at the end of the solenoid valve at times generates a pressure increase that also tries to re-close the valve during the time of the spilling event.

The intermittent bypass is achieved by pulsing a solenoid valve between pumping events, e.g., periodically pulsing a solenoid valve fully or partially synchronized with injection events (every event, every other one, every third or fourth injection event, etc.). Although this half synchronization will result in slightly higher pressure variation (two steps) and also higher pressure pulsation at WOT operation (twice as much fuel is supplied during the pumping event compared to full synchronization) in the rail, it is desirable where the it would be too difficult or impossible to fully refill the rail (inefficiency because of retraction and re-pressurization of the internal high pressure circuit) in the short time available, especially at high speed.

Both pre-spill(ing) and after-spill(ing) terms relate to the timing of the spilling event relative to the cam profile. Pre-spill is the term used when the spill valve is kept open during the initial portion of the piston motion as it follows the cam profile from the base circle. This means the spilling event precedes the pumping event, which start coincides with spill valve closure. The pumping event ends when the piston reached TDC. The term after-spill is used when the pumping starts immediately (as soon as the piston starts to move from BDC toward TDC) and the pumping event is terminated by spill valve opening (for example to reduce the Hertzian stress on cam nose). In this case spilling follows the pumping event and because of that is called after-spilling

What is claimed is:

1. In a fuel supply system for an internal combustion engine, a method for controlling fuel quantity delivery from a high pressure, reciprocating piston, engine-driven fuel pump to a high pressure common rail having a plurality of fuel injection nozzles for injecting fuel into the cylinders of the engine, comprising:

establishing at least two control regimes corresponding to a respective low engine speed pump operation and high engine speed pump operation;

during the control regime for low speed operation, feeding unregulated low pressure fuel to the pumping pistons and at a location between the pumping pistons and the common rail, diverting excess fuel discharged from the pumping pistons to a location of relatively low pressure in the fuel supply system, upstream of the pumping pistons; and during the control regime for high-speed operation, regulating the quantity of low pressure feed fuel pressurized by the pumping pistons and delivering all of the fuel discharged from the pumping pistons, to the common rail.

2. The method of claim 1, wherein during high speed operation, the regulation of the quantity of low pressure feed fuel pressurized by the pumping pistons is achieved by passing the feed fuel through an adjustable inlet flow restrictor.

3. The method of claim 2, wherein said flow restrictor is operated by a proportional solenoid valve.

4. The method of claim 1, wherein during high speed operation the regulation of the quantity of low pressure feed fuel pressurized by the pumping pistons is achieved by pre-spilling some of the feed fuel.

5. The method of claim 4, wherein the pre-spilling is achieved by a solenoid valve.

6. The method of claim 5, wherein the diversion of excess fuel during low speed operation includes pulsing said solenoid valve intermittently in synchronization with the injection events.

7. The method of claim 1, wherein at low speed operation the diversion of excess fuel discharged from the pumping pistons to a location of relatively low pressure in the fuel supply system is achieved by opening a control valve to divert said fuel during a time interval between injection events.

8. The method of claim 7, wherein the opening of the control valve is achieved by pulsing a solenoid valve a plurality of cycles when none of the nozzles is injecting fuel into the engine.

9. The method of claim 7, wherein a one-way check valve is situated between the pumping pistons and the common rail, and said location between the pumping pistons and the common rail for diverting excess fuel is between the pumping pistons and said check valve.

10. The method of claim 9, wherein the fuel supply system includes a fuel tank and a low pressure fuel feed line from the fuel tank to a low pressure pump inlet passage, and wherein the excess fuel is diverted to the low pressure feed line.

11. The method of claim 9, wherein the fuel supply system includes a fuel tank and a low pressure fuel feed line from the fuel tank to a low pressure pump inlet passage, and wherein the excess fuel is diverted to the low pressure pump inlet passage.

12. The method of claim 1, wherein regulating the quantity of low pressure fuel includes passing the fuel through a calibrated orifice.

13. The method of claim 1, wherein the engine has a speed corresponding to maximum power and a lower engine speed corresponding to maximum torque, and wherein the high speed control is implemented for all engine speeds above the speed corresponding to maximum torque.

14. The method of claim 1, wherein the engine has a speed corresponding to maximum power and a lower engine speed corresponding to maximum torque, and wherein for substantially all speeds above the speed corresponding to maximum torque, the regulation of low pressure fuel includes a flow restriction on feeding that increases with engine speed such that the pumping rate monotonically decreases with engine speed.

15. The method of claim 1, wherein the engine has a speed corresponding to wide open throttle and wherein the low speed control regime is implemented for engine speeds up to approximately one half the speed corresponding to wide open throttle, and at speeds above the speed corresponding to approximately one-half wide open throttle, the high speed control regime feed flow to the pumping piston is increasingly restricted with increasing engine speed.

16. The method of claim 1, wherein the engine speed corresponding to wide open throttle is at least about 6000 rpm, and the speed at which the high speed control regime is initiated for restricted feed flow to the pumping pistons, occurs at an engine speed in the range of about 2000–4000 rpm.

17. The method of claim 16, wherein the transition from unrestricted to restricted charging occurs at an engine speed in the range of about 2600 to 3000 rpm.

18. In a fuel supply system for an internal combustion engine, having a fuel tank, a low pressure fuel feed line for delivering low pressure fuel to an inlet passage of a reciprocating piston, engine-driven fuel pump, the pistons receiving fuel in a charging phase from a charging chamber fluidly connected to the inlet passage and discharging high pressure fuel in a discharge phase into a discharge line for delivering high pressure fuel to a common rail having a plurality of fuel injection nozzles for injecting fuel into the cylinders of the engine, a one-way check valve situated in the discharge line between the pistons and the common rail, and a control valve operatively connected between the piston and the check valve for diverting excess fuel discharged from the piston, to the pump inlet passage, a method for controlling fuel quantity delivery to the common rail, comprising:

establishing at least two control regimes corresponding to a respective low engine speed pump operation and high engine speed pump operation;

during low speed operation, feeding unregulated low pressure fuel to the charging chamber of the pistons and at a location between the pistons and the common rail, operating said control valve between nozzle injection events to divert excess fuel discharged from the pistons, to said pump inlet passage, thereby establishing an intermittent low pressure recirculation circuit through the pump; and during high speed operation, operating said control valve between piston discharges to regulate the quantity of low pressure feed fuel to the charging chamber and delivering all of the fuel discharged from the pistons, to the common rail.

19. The method of claim 18, wherein the start of control valve opening is timed to coincide with the completion of discharge of each piston.

20. The method of claim 18, wherein the operation of said control valve between piston discharges closes to stop flow of low pressure fuel from said pump inlet passage into the charging chamber.

21. The method of claim 18, wherein a flow control orifice is situated in the inlet passage such that during said low speed control regime the feed flow is unregulated but during said high speed control regime said control orifice restricts feed flow to a rate equal to or slightly above the rate corresponding to wide open throttle quantity at the maximum (rated) engine speed.

* * * * *